United States Patent [19]

Ambasz

[11] 4,181,521

[45] Jan. 1, 1980

[54] PREPARATION OF GLASS-FORMING ALLOYS UNDER A REFINING METAL OXIDE/BORON TRIOXIDE SLAG

[75] Inventor: Wiktor J. Ambasz, Metuchen, N.J.

[73] Assignee: Allied Chemical Corporation, Morris Township, Morris County, N.J.

[21] Appl. No.: 925,578

[22] Filed: Jul. 17, 1978

[51] Int. Cl.[2] ..... C21C 3/04

[52] U.S. Cl. ..... 75/53; 75/129; 75/257

[58] Field of Search ..... 75/53, 129, 257

[56] References Cited

U.S. PATENT DOCUMENTS

| | | | |
|---|---|---|---|
| 2,823,112 | 2/1958 | Miller | 75/257 |
| 4,084,959 | 4/1978 | Yamamoto | 75/53 |

*Primary Examiner*—P. D. Rosenberg

*Attorney, Agent, or Firm*—Gerhard H. Fuchs; Ernest D. Buff

[57] ABSTRACT

Melting of iron/nickel/cobalt based glass-forming alloys, especially phosphorus-containing alloys under a refining metal oxide/boron trioxide slag, reduces undesirable metal oxide impurities, such as titanium dioxide impurities, prevents oxidation of the melt, and reduces loss of phosphorus values from the melt.

9 Claims, No Drawings

PREPARATION OF GLASS-FORMING ALLOYS UNDER A REFINING METAL OXIDE/BORON TRIOXIDE SLAG

BACKGROUND OF THE INVENTION

Recent advances in the metallurgical arts include development of alloys which, when rapidly quenched from the melt at temperature in excess of about $10^{4°}$ to $10^{6°}$ C. per second, form glassy (amorphous) solids. Such glass forming alloys commonly are based on transition metals, usually iron, nickel and/or cobalt, in conjunction with one or more metalloids of phosphorus, boron and carbon. Glass-forming alloys are, for example, described in U.S. Pat. No. 3,856,513 issued Dec. 24, 1974 to Chen et al. Glassy solid structures are obtained from such alloys by processes such as the melt spin process wherein a fine jet of the molten alloy is impinged upon a rapidly moving chill surface for solidification. Orifice diameters in this process are exceedingly small, and orifice pluggage on account of solid impurities contained in the melt can represent serious problems. Iron, cobalt or nickel based phosphorus-containing glass-forming alloys which additionally contain boron as a metalloid are particularly prone to contamination with solid particles. In such alloy, these particles were found to be predominantly small particles of $TiO_2$ and/or $TiBO_3$, both of which have high melting points, and both of which are relatively insoluble in the melt. it was found that titanium is an impurity commonly contained in ferrophosphorus, which is used as a source of phosphorus in making these alloys, although titanium may also be present as contaminant in other raw materials employed in making these alloys.

The present invention provides a refining slag for reducing contamination of iron, nickel and/or cobalt-based alloys, especially phosphorus-containing alloys, which slag further reduces phosphorus losses from the melt, as well as oxidation of the melt.

SUMMARY OF THE INVENTION

In accordance with the present invention, iron, nickel and/or cobalt-based alloys, especially iron, nickel and/or cobalt-based phosphorus-containing alloys, are melted under a slag comprising oxides of iron, nickel and/or cobalt together with boron trioxide. The slag layer protects the molten alloy from oxidation, reduces or eliminates contamination of the melt with particulate matter, especially metal oxides, and prevents loss of phosphorus values by vaporization.

The alloys which benefit from melting under the refining slag of the present invention have the general formula $M_aP_bY_c$ wherein M is a metal selected from one or more of the group consisting of iron, cobalt and nickel; P represents phosphorus; Y represents a metalloid selected from one or both of the group consisting of boron and carbon; and a, b and c are in atomic percent, wherein a is about 70 to 90, b is 0–20, but desirably at least 1, e is 0 to 30, the sum of b+c is about 10 to 30, the sum of a+b+c being 100. In the above formula, up to about 80 percent of M may be replaced by one or more of any transition metal other than iron cobalt and nickel. Suitable replacements include silicon, chromium, vanadium, aluminum, tin, antimony, germanium, indium, beryllium, molybdenum, titanium, manganese, tungsten, zirconium, hafnium and copper, for example. The phosphorus content of the alloys, if phosphorus is present, will ordinarily be derived from ferrophosphorus, which may be of any suitable phosphorus content, such as commercially available grades containing about 18 and 25 percent by weight phosphorus.

Boron trioxide is one of the two essential ingredients in the slag. The other essential ingredient is an oxide of iron, cobalt or nickel. Suitably, the oxide is chosen to correspond to the major metal content of the alloy. For example, if iron is the only or major metal component of the alloy, the oxide component in the slag desirably, but not necessarily, is an oxide of iron. Nickel-containing melts desirably are refined under a slag containing nickel oxide. The slag desirably contains from about 20 to 80 percent of weight boron trioxide.

DETAILED DESCRIPTION OF THE INVENTION AND OF THE PREFERRED EMBODIMENTS

In the slag employed in the present invention the metal oxide (e.g. iron, cobalt or nickel oxide) coact with the boron trioxide to obtain the desired result. Although I do not wish to be bound by the explanation, I believe that oxygen from the metal oxide combines with titanium metal contained in the melt as an impurity, perhaps forming $TiO_2$, which is then bound in the molten slag. The boron trioxide seems to act as a coagulant for the titanium dioxide as well as for other particulate matter which may be contained in the melt. Moreover, the boron trioxide, because of its acidic character, seemingly tends to prevent oxidation of phosphorus, if present, to the five valent oxide state, as might occur due to presence of small amounts of oxygen in the melt. In the five valent state, phosphorus is volatile under refining conditions encountered in making the alloys here under consideration.

Of the oxides of iron, namely FeO, $Fe_2O_3$ and $Fe_3O_4$, all are suitable, FeO being preferred. Likewise, any of the oxides of cobalt, CoO, $Co_2O_3$, as well as $Co_3O_4$, may be employed. However, for reasons in high cost, use of oxides of cobalt is not ordinarily preferred. Nickel oxide, for reasons of availability as well as effectiveness, is the preferred metal oxide. Metal oxides of commercial degree of purity are suitable for use.

The boron trioxide ($B_2O_3$) similarly may be of any degree commercial purity.

The boron trioxide is desirably employed in amount of 20 to 80 percent by weight, preferably 30 to 70 percent by weight, most preferably 40 to 60 percent by weight of the slag, the balance being represented by the metal oxide. Of course, if desired, other components which do not materially interfere with the protective and refining functions of the slag may be included in the slag composition for any desired purpose, e.g. melting point reduction, although addition of other components is not ordinarily preferred. The slag composition of the present invention is employed in amount sufficient to provide a slag layer of between about 1 and 50 millimeter thickenss, preferably between about 2 and 10 millimeter thickness on top of the molten metal alloy. It is an advantage of the slag composition of the present invention that its solubility in the alloy is generally low, so that gross contamination of the alloy with the slag is avoided. Furthermore, minor contamination of the alloy with boron values from the slag is generally not deleterious, that is to say that such contamination would not adversely affect the glass-forming capabilities of the alloy, nor its properties in the solid state.

As previously stated, the slag composition of the present invention has a refining function. To that end, the slag should remain in contact with the surface of the melt at melting temperature for a time period of at least about one minute, desirably of at least about 5 minutes. Contact times of, say, between about 5 minutes and 5 hours, desirably of between about 30 minutes and about 3 hours are eminently suitable. If desired, the melt may be agitated. Melting furnaces suitable for use in the practice of the present invention include those lined with high temperature ceramic materials. Preferred furnace linings are made from magnesia, zirconia and alumina. If desired, suitable inert atmospheres may be provided above the slag, including such as those provided by helium or argon. Alternatively, the melting operation may be conducted under vacuum. However, provision of inert atmospheres is not essential. If an inert atmosphere is supplied, argon is preferred.

The slag may be added to the metal before, during or after the melting operation, or before or after all of the ingredients of the alloy have been added to the melt, the order of addition being unimportant. The melt may be heated by any conventional means, induction heating being preferred.

EXAMPLE

This example illustrates production of an alloy containing Fe: 45.9±1 percent by weight; Ni: 44.6±1 percent by weight; P: 7.85±0.32 percent by weight; B: 1.45±0.11 percent by weight. The raw materials charged are iron, electrolytic fragments, 99.9 percent pure; nickel pellets, 99.9 percent pure; ferrophosphorus, low silicon grade (less than about 0.5 percent silicon); nickel-boron, low aluminum grade (as available, for example, from Shieldalloy Company). Prior to and during the charging operation the furnace is purged with argon gas. The required amounts of iron, nickel and ferrophosphorus are charged to the furnace, and the charge is gradually heated until melting. At that point, an oxidizing acid slag consisting of about 50 weight percent nickel oxide and about 50 weight percent $B_2O_3$ is added to the molten charge in an amount of about 8 lbs. per 2,500 lb. metal charge to produce about a ⅛ inch thick layer of slag. The melt is refined under this slag at a temperature of about 1,180° to 1,200° C. for 20 to 30 minutes, taking care to avoid temperatures in excess of 1200° C. during the refining operation. Thereafter, the slag is skimmed and the nickel boron is added to the melt. The heat is finished under an argon blanket. Total refining and holding time at the 1,180° to 1,200° C. is about 45 to 60 minutes. The refined alloy is then cast at about 1,000° C. under an argon blanket.

Using identical raw materials, alloy of the above composition prepared using the $NiO/B_2O_3$ slag as above described had a titanium content of only 0.04 percent by weight, whereas an alloy obtained under otherwise identical conditions from the same raw materials, but without use of the slag, had a titanium content of about 0.16 percent by weight. Furthermore, alloy prepared under conditions of the present invention had significantly lower contamination with other oxidizable elements which tend to form insoluble solid oxides. As a consequence, metal refined in accordance with the present invention, as above described, caused substantially less restriction of a casting nozzle in a subsequent spin casting operation.

When other glass-forming metal alloys of the above-stated formula are refined using the slag employed in the above example, or using slags containing iron, cobalt and/or nickel oxides alone, or in any combination, similar results are obtained, that is to say, the resultant alloys have reduced contamination with solid particulate impurities, loss of phosphorus values from the melt is reduced, and oxidation of the melt is substantially prevented.

Since various changes may be made in carrying out the present invention without departing from its scope and essential characteristics, all matter contained in the above description shall be interpreted as illustrative only, the scope of my invention being defined by the appended claims.

I claim

1. In the process of making alloys of the formula $M_aP_bY_c$ wherein

M is a metal selected from the group consisting of iron, cobalt, nickel, and mixtures thereof in any proportion, P represent phosphorus, Y is a metalloid selected from the group consisting of boron, carbon, and mixtures thereof in any proportion, a, b, and c are in atomic percent; and a is about 70 to 90, b is 0 to 20, c is 0 to 30, the sum of b+c is about 10 to 30, the sum of a+b+c being 100, the improvement which comprises holding the molten alloy in contact with a slag comprising oxides selected from the group consisting of oxides of iron, nickel, and cobalt and mixtures thereof together with boron trioxide.

2. The improvement of claim 1, wherein in the alloy of the formula $M_aP_bY_c$ b is at least about 1.

3. The improvement of claim 2 wherein the slag comprises between about 20 and 80 percent by weight of $B_2O_3$, and between about 80 and 20 percent by weight of one or more oxides of iron, cobalt and nickel.

4. The improvement of claim 2 wherein the phosphorus in the metal alloy is derived from ferrophosphorus.

5. The improvement of claim 2 wherein the alloy is an alloy of iron and nickel.

6. The improvement of claim 5 wherein the alloy contains both phosphorus and boron, in combination.

7. The improvement of claim 6 wherein the phosphorus in the alloy is derived from ferrophosphorus.

8. The improvement of claim 7 wherein the slag comprises between about 20 and 80 weight percent of $B_2O_3$, and correspondingly between about 80 and 20 weight percent of NiO.

9. The improvement of claim 1 wherein the alloy comprises about 46±1 percent by weight of Fe; about 45±1 percent by weight of Ni; about 8±0.5 percent by weight of P; about 1 ±0.5 percent by weight of B, wherein the phosphorus is derived from ferrophosphorus, wherein the slag comprises about equal amount of NiO and $B_2O_3$, and the molten alloy is held in contact with the slag for period of between about 5 minutes and 5 hours.

* * * * *